US010453633B2

(12) United States Patent
Wang

(10) Patent No.: US 10,453,633 B2
(45) Date of Patent: Oct. 22, 2019

(54) MULTIFUNCTIONAL CAPACITIVE-TYPE SLEEVE WITH VACUUM ARC-EXTINGUISHING CHAMBER

(71) Applicant: BEIJING RUIHENG XINYUAN INVESTMENT CO., LTD, Beijing (CN)

(72) Inventor: Huan Wang, Beijing (CN)

(73) Assignee: BEIJING RUIHENG XINYUAN INVESTMENT CO., LTD (CN)

( * ) Notice: Subject to any disclaimer, the term of this patent is extended or adjusted under 35 U.S.C. 154(b) by 0 days.

(21) Appl. No.: 15/769,982

(22) PCT Filed: Oct. 21, 2016

(86) PCT No.: PCT/CN2016/102795
§ 371 (c)(1),
(2) Date: Apr. 20, 2018

(87) PCT Pub. No.: WO2017/067494
PCT Pub. Date: Apr. 27, 2017

(65) Prior Publication Data

US 2018/0301304 A1 Oct. 18, 2018

(30) Foreign Application Priority Data

Oct. 23, 2015 (CN) ..... 2015 1 0696089

(51) Int. Cl.
*H01H 33/662* (2006.01)
*H01H 33/664* (2006.01)
*H01B 17/28* (2006.01)

(52) U.S. Cl.
CPC ..... *H01H 33/66207* (2013.01); *H01B 17/28* (2013.01); *H01H 33/664* (2013.01);
(Continued)

(58) Field of Classification Search
CPC ..... H01H 33/66207; H01H 33/662; H01H 33/66261; H01H 2033/6623; H01B 17/28; H01B 17/56; G01R 15/06
(Continued)

(56) References Cited

U.S. PATENT DOCUMENTS 1,935,228 A * 11/1933 Kopeliowitsch ..... H01B 17/005 174/31 R
3,541,284 A 11/1970 Wachta
(Continued)

FOREIGN PATENT DOCUMENTS

CN 2354218 Y 12/1999
CN 2583773 Y 10/2003
(Continued)

OTHER PUBLICATIONS

International Search Report dated Dec. 29, 2016 in corresponding PCT International Application No. PCT/CN2016/102795.
(Continued)

*Primary Examiner* — Truc T Nguyen
*Assistant Examiner* — William A Bolton
(74) *Attorney, Agent, or Firm* — Ostrolenk Faber LLP

(57) ABSTRACT

A multifunctional capacitive-type sleeve with a vacuum arc-extinguishing chamber comprises a sleeve insulation core covered outside the vacuum arc-extinguishing chamber, wherein one ends of two connection terminals are respectively led out from the two ends of the sleeve insulation core, and the other ends of the two connection terminals can be contacted and separated in the vacuum arc-extinguishing chamber to switch on and off a circuit. The multifunctional capacitive-type sleeve with a vacuum arc-extinguishing chamber according to the present invention not only has the function of a sleeve, but also has the function of a disconnector, the sleeve insulation core is
(Continued)

internally provided with a vacuum arc-extinguishing chamber to switch on and off the circuit, which can simplify structures of a high-voltage switch and a control cabinet, reduce the device volume, and decrease the device cost.

8 Claims, 3 Drawing Sheets

(52) U.S. Cl.
CPC ..... *H01H 33/66261* (2013.01); *H01H 2033/6623* (2013.01)

(58) Field of Classification Search
USPC ..... 218/139, 134, 138, 144, 145; 200/600
See application file for complete search history.

(56) References Cited

U.S. PATENT DOCUMENTS 5,585,611 A * 12/1996 Harvey ..... H01H 33/027 218/134
5,808,258 A * 9/1998 Luzzi ..... H01H 33/66207 218/136
5,917,167 A * 6/1999 Bestel ..... B29C 63/18 218/138
6,828,521 B2 * 12/2004 Stoving ..... H01H 33/666 218/134
7,285,743 B2 * 10/2007 Martin ..... H01H 33/027 218/136
8,658,932 B2 * 2/2014 Schellekens ..... H01H 9/54 218/122
8,785,802 B2 * 7/2014 Shang ..... H01H 33/66207 218/120
2007/0235415 A1 * 10/2007 Claus ..... H01H 33/66207 218/139
2011/0120976 A1 * 5/2011 Gentsch ..... H01H 9/52 218/139
2012/0145674 A1 6/2012 Schellekens et al. ..... 218/122

FOREIGN PATENT DOCUMENTS

CN 1892929 A 1/2007
CN 102543564 A 7/2012
CN 205230929 U 5/2016
DE 10 2007 004 430 7/2008
JP H10-92277 A 4/1998

OTHER PUBLICATIONS

Written Opinion dated Dec. 29, 2016 in corresponding PCT International Application No. PCT/CN2016/102795.
Search Report mailed in corresponding Chinese Patent Application No. 201510696089.
European Search Report issued in European Patent Application No. 16856925 dated May 16, 2019.

* cited by examiner

MULTIFUNCTIONAL CAPACITIVE-TYPE SLEEVE WITH VACUUM ARC-EXTINGUISHING CHAMBER

CROSS-REFERENCE TO RELATED APPLICATIONS

The present application is a 35 U.S.C. §§ 371 national phase conversion of PCT/CN2016/102795, filed Oct. 21, 2016, which claims priority to Chinese Patent Application No. 201510696089.4, filed Oct. 23, 2015, the contents of which are incorporated herein by reference. The PCT International Application was published in the Chinese language.

TECHNICAL FIELD

The present invention belongs to the field of high-voltage electrical appliances, and more particularly, to a multifunctional capacitive-type sleeve with a vacuum arc-extinguishing chamber, which can be used as a sleeve and a high-voltage switch.

BACKGROUND ART

A high-voltage vacuum circuit breaker is usually used in the existing power distribution station and transformer substation to switch on and off a circuit. The existing vacuum circuit breaker is usually composed of several components including a box body, a vacuum arc-extinguishing chamber, upper and lower support insulating cylinders, a lead terminal, a flange, a current transformer, an insulating pull rod with the functions of switching and electric current measurement and the problems of large volume, complicated structure, high cost and complicated installation and maintenance. With the popularization of modern smart power grids, the simplification of electrical device, the integration of functions and the modularization are increasingly required, so that the installation, operation and maintenance of the device is simpler and easier.

SUMMARY OF THE INVENTION

The object of the present invention lies in overcoming the defects of the prior art and provides a multifunctional capacitive-type sleeve with a vacuum arc-extinguishing chamber with simple structure, low cost and convenient maintenance, which not only has the function of a sleeve, but also has the function of a disconnector. In addition, the functions of circuit current signal, voltage signal and high-voltage electric energy taking.

In order to realize the object above, the following technical solution is used in the present invention.

A multifunctional capacitive-type sleeve with a vacuum arc-extinguishing chamber comprises a capacitive-type sleeve insulation core 4 covered outside the vacuum arc-extinguishing chamber 7, wherein one ends of two connection terminals 1 are respectively led out from the two ends of the sleeve insulation core 4, and the other ends of the two connection terminals 1 can be contacted and separated in the vacuum arc-extinguishing chamber 7 to switch on and off a circuit.

Regarding to a preferred embodiment of the present invention, capactive screen group 5 composed of a plurality of coaxial capactive screens alternatively arranged with an insulating layer is embedded in the sleeve insulation core 4, and the outermost capactive screen is an earthing screen 50.

Further, the capactive screen group 5 comprises main capactive screens 51 forming a main capacitor C1, voltage-dividing capactive screens 52 forming a voltage-dividing capacitor C2 and shielding capactive screens 53 forming a shielding capacitor C3; and the main capacitor C1 and the voltage-dividing capacitor C2 are connected in series to form a capacitive voltage divider for providing voltage signal output, and the shielding capacitor C3 plays a role of shielding and protecting.

Regarding to another embodiment of the present invention, two capactive screen groups 5 are embedded in the sleeve insulation core 4, the two capactive screen groups 5 are respectively arranged at the two ends of the sleeve insulation core 4, and the earthing screens 50 of the two capactive screen groups 5 are connected.

Further, the plurality of coaxial capactive screens of each capactive screen group 5 are arranged in a manner of ladder-like deviation from inside to outside gradually along an axial direction from one end of the sleeve insulation core 4 to a middle part provided with the vacuum arc-extinguishing chamber 7.

Further, the vacuum arc-extinguishing chamber 7 is arranged in the middle part in the chamber of the sleeve insulation core 4, the two ends of the vacuum arc-extinguishing chamber 7 are provided with an arc-extinguishing chamber flange 8, the two capactive screen groups 5 are respectively embedded at the positions in the two ends of the sleeve insulation core 4 surrounding the two arc-extinguishing chamber flanges 8, and each capatitive screen in each capactive screen group 5 surrounds one corresponding arc-extinguishing chamber flange 8.

Further, the two capactive screen groups 5 in the sleeve insulation core 4 respectively form the main capacitor C1, the voltage-dividing capacitor C2 and the shielding capacitor C3, the main capacitor C1 and the voltage-dividing capacitor C2 are connected in series to form the capacitive voltage divider for providing voltage signal output, and the shielding capacitor C3 plays a role of shielding and protecting; wherein both the two ends of the main capacitor C1 after in series connection with the voltage-dividing capacitor C2 of one capactive screen group 5, and the two ends of the shielding capacitor C3 of one capactive screen group 5 are respectively connected to the connection terminal at end of the multifunctional capacitive-type sleeve and an earth potential E; both the two ends of the main capacitor C1 after in series connection with the a voltage-dividing capacitor C2 of the other capactive screen group 5, and the two ends of the shielding capacitor C3 of the other capactive screen group 5 are respectively connected to the connection terminal at the other end of the multifunctional capacitive-type sleeve and the earth potential E; and a current transformer secondary coil 6 is sleeved in the scope of the earthing screen of the two capactive screen groups 5 outside the the sleeve insulation core 4.

Preferred, an insulating umbrella skirt 3 is further sleeved outside the sleeve insulation core 4, and both the two ends of the sleeve insulation core 4 are provided with a voltage-sharing flange 2.

Preferred, one or more current transformer secondary coils 6 are further sleeved outside the sleeve insulation core 4.

Regarding to another preferred embodiment, the vacuum arc-extinguishing chamber 7 is arranged in the middle part in the chamber of the sleeve insulation core 4, the two ends of the vacuum arc-extinguishing chamber 7 are provided with the arc-extinguishing chamber flange 8, the two capactive screen groups 5 are respectively embedded at the positions in the two ends of the sleeve insulation core 4 surrounding the two arc-extinguishing chamber flanges 8, each capatitive screen in each capactive screen group 5 surrounds one corresponding arc-extinguishing chamber flange 8, and the plurality of coaxial capactive screens of each capactive screen group 5 are arranged in a manner of ladder-like deviation from inside to outside gradually along the axial direction from one end of the sleeve insulation core 4 to the middle part provided with the vacuum arc-extinguishing chamber 7; and the current transformer secondary coil 6 is sleeved outside the sleeve insulation core 4 at the position corresponding to the vacuum arc-extinguishing chamber 7, two insulating umbrella skirts 3 are respectively sleeved at the two ends outside the sleeve insulation core 4, and both the two ends of the sleeve insulation core 4 are provided with a voltage-sharing flange 2.

The multifunctional capacitive-type sleeve with a vacuum arc-extinguishing chamber according to the present invention not only has the function of a sleeve, but also has the function of a disconnector, the sleeve insulation core is internally provided with a vacuum arc-extinguishing chamber to switch on and off the circuit, which can simplify structures of a high-voltage switch and a control cabinet, reduce the device volume, and decrease the device cost. In addition, the shielding capacitor and the capacitive voltage divider are formed in the sleeve insulation core, and the exterior is provided with the current transformer to increase the monitoring function, so that the electrical device is integrated, modularized and intelligentized, which not only facilitates the maintenance and change, but also is more energy-saving and environmental.

DETAILED DESCRIPTION OF THE PREFERRED EMBODIMENTS

Figure 1:
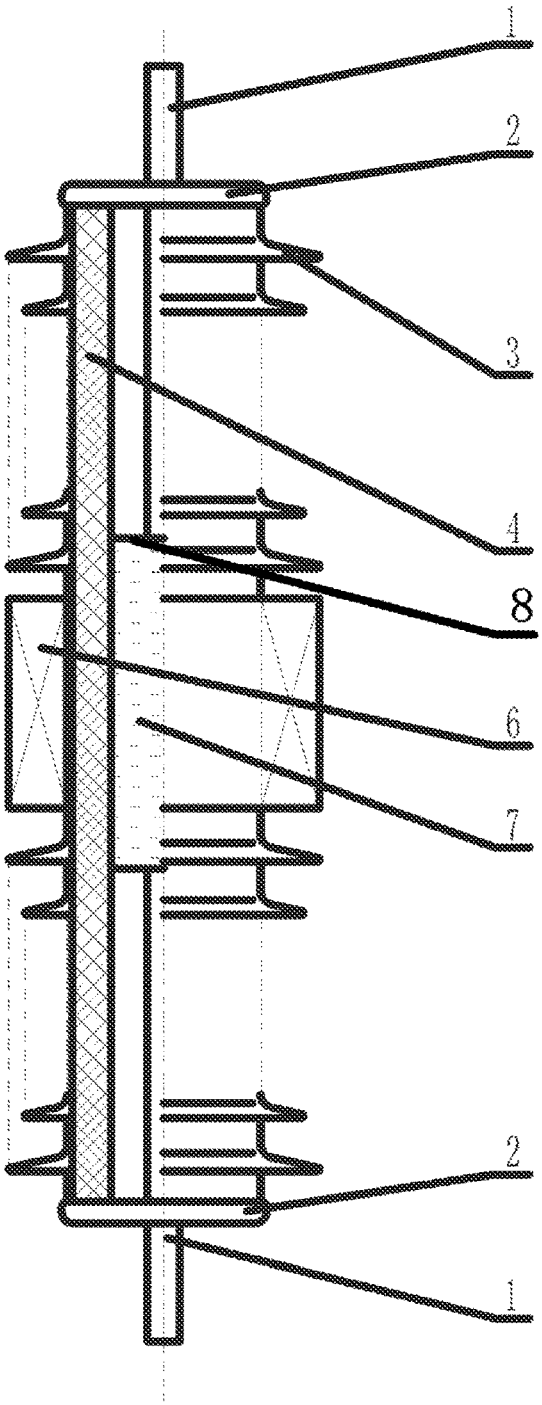
FIG. 1 is a structural schematic diagram of a multifunctional capacitive-type sleeve according to the present invention.
Figure 2:
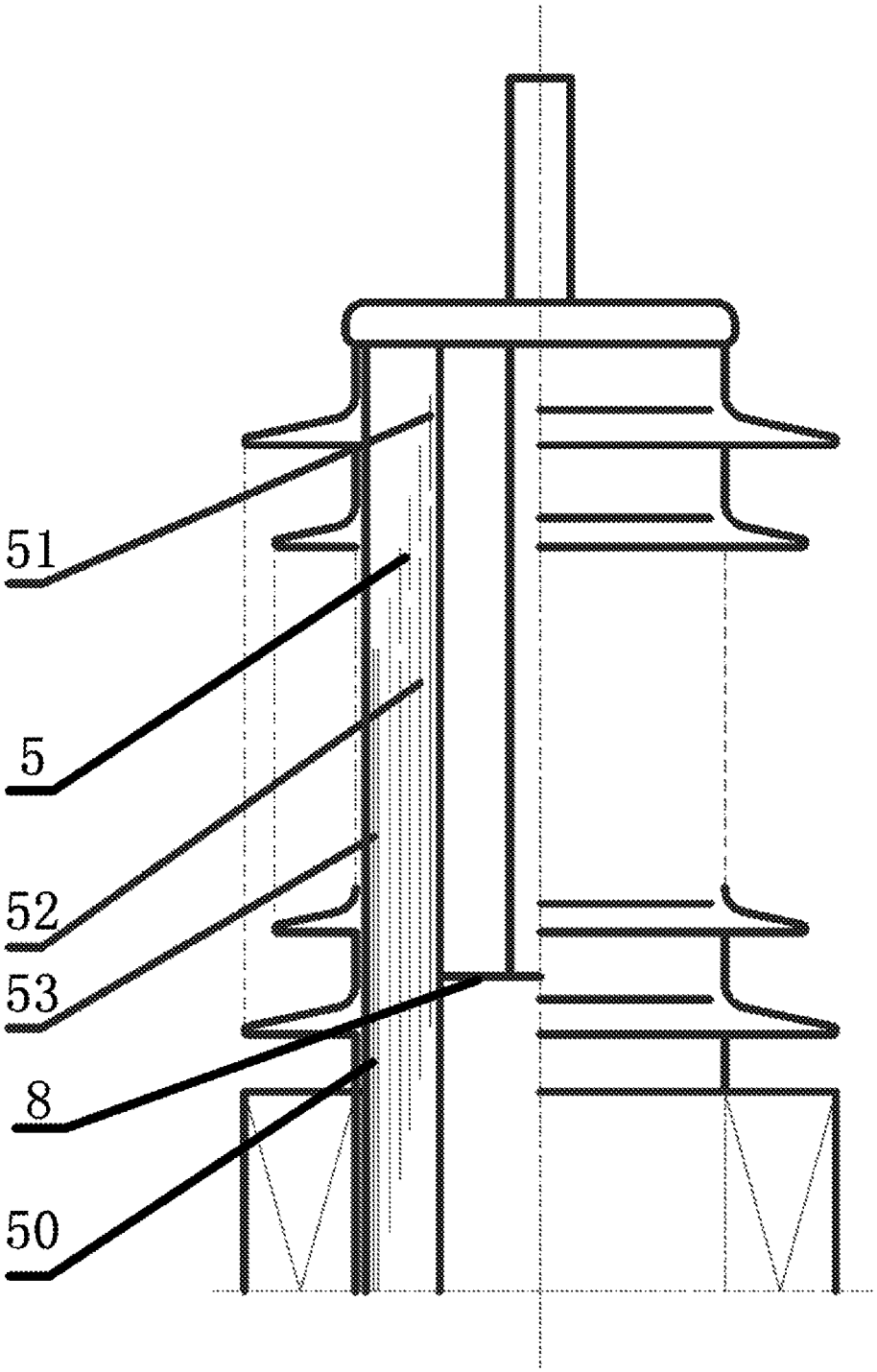
FIG. 2 is a structural schematic diagram of a sleeve insulation core according to the present invention.
Figure 3:
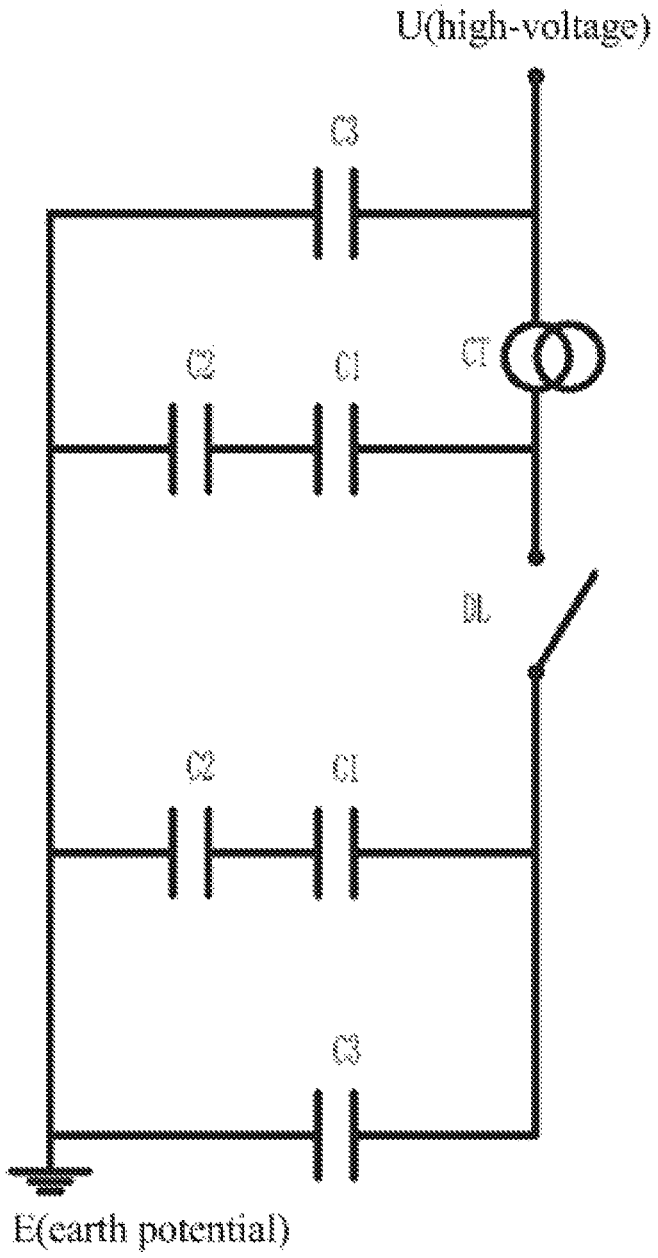
FIG. 3 is a principle diagram of a circuit according to the present invention.

The detailed description of the preferred embodiments of the multifunctional capacitive-type sleeve with a vacuum arc-extinguishing chamber according to the present invention is further described with reference to the embodiments as shown in FIG. 1 to FIG. 3. The multifunctional capacitive-type sleeve with a vacuum arc-extinguishing chamber according to the present invention is not limited to the description of the following embodiments.

As shown in FIGS. 1 to 2, a multifunctional capacitive-type sleeve with a vacuum arc-extinguishing chamber according to the present invention comprises a vacuum arc-extinguishing chamber 7, a capacitive-type sleeve insulation core 4, a voltage-sharing flange 2 arranged in two ends of the sleeve insulation core 4, and an insulating umbrella skirt 3 sleeved outside the sleeve insulation core 4; the sleeve insulation core 4 is sleeved outside the vacuum arc-extinguishing chamber 7, one ends of two connection terminals 1 are respectively led out from the two ends of the sleeve insulation core 4, the other ends of the two connection terminals 1 can be contacted and separated in the vacuum arc-extinguishing chamber 7 to switch on and off a circuit, an insulating pull rod or an operating mechanism can drive at least one connection terminal 1 to move to be contacted with or separated from the two connection terminals 1, and one or more current transformer secondary coils 6 are sleeved outside the sleeve insulation core 4. A capactive screen group 5 composed of a plurality of coaxial capactive screens alternatively arranged with an insulating layer is embedded in the sleeve insulation core 4, the outermost capactive screen is an earthing screen 50, and the capactive screen group 5 can play a role of shielding and protecting to a high-voltage circuit. The capactive screen group 5 comprises main capactive screens 51 forming a main capacitor C1, voltage-dividing capactive screens 52 forming a voltage-dividing capacitor C2 and shielding capactive screens 53 forming a shielding capacitor C3; and the main capacitor C1 and the voltage-dividing capacitor C2 are connected in series to form a capacitive voltage divider for providing voltage signal output to be used for measuring the voltage, and the shielding capacitor C3 plays a role of shielding and protecting.

The multifunctional capacitive-type sleeve with a vacuum arc-extinguishing chamber according to the present invention not only has the function of a sleeve, but also has the function of a disconnector, the sleeve insulation core is internally provided with a vacuum arc-extinguishing chamber to switch on and off the circuit, which can simplify structures of a high-voltage switch and a control cabinet, reduce the device volume, and decrease the device cost. The vacuum arc-extinguishing chamber is arranged in the sleeve with a capactive screen structure, the connection terminals are installed in two ends, and the function of the disconnector is realized through the insulating pull rod and the operating mechanism; two ends of the sleeve are provided with the flange to improve the electric field at two ends of the sleeve; the main capacitor C1 and the voltage-dividing capacitor C2 are arranged to form the capacitive voltage divider to provide the voltage signal output to be used for measuring the voltage; the shielding capacitor C3 is arranged to guarantee the stability of the voltage measurement signal without being affected by external environment; and a secondary coil is installed in an earthing scope outside the sleeve, which is used for providing the functions of measurement of current signal and high-voltage electric energy taking.

As shown in FIGS. 2 to 3, regarding to a preferred embodiment of a multifunctional capacitive-type sleeve with a vacuum arc-extinguishing chamber according to the present invention, two capactive screen groups 5 are embedded in the sleeve insulation core 4, the two capactive screen groups 5 are respectively and symmetrically arranged at the two ends of the sleeve insulation core 4, the earthing screens 50 of the two capactive screen groups 5 are connected, the plurality of coaxial capactive screens of each capactive screen group 5 are arranged in a manner of ladder-like deviation from inside to outside gradually along an axial direction from one end of the sleeve insulation core 4 to a middle part provided with the vacuum arc-extinguishing chamber 7. Further, the vacuum arc-extinguishing chamber 7 is arranged in the middle part in the chamber of the sleeve insulation core 4, the two ends of the vacuum arc-extinguishing chamber 7 are provided with an arc-extinguishing chamber flange 8, the two capactive screen groups 5 are respectively embedded at the positions in the two ends of the sleeve insulation core 4 surrounding the two arc-extinguishing chamber flanges 8, and each capatitive screen in each capactive screen group 5 surrounds one corresponding arc-extinguishing chamber flange 8 to play a role of shielding and protecting. A current transformer secondary coil 6 is sleeved outside the sleeve insulation core 4, the current transformer secondary coil 6 is sleeved in the scope of the earthing screen outside the the sleeve insulation core 4, and preferredly, the current transformer secondary coil 6 can be sleeved outside the sleeve insulation core 4 at the position corresponding to the vacuum arc-extinguishing chamber 7. Two insulating umbrella skirts 3 are respectively sleeved at the two ends outside the sleeve insulation core 4, and the insulating umbrella skirt 3 is made of insulating silicone rubber.

The two capactive screen groups 5 in the sleeve insulation core 4 respectively form the main capacitor C1, the voltage-dividing capacitor C2 and the shielding capacitor C3, the main capacitor C1 and the voltage-dividing capacitor C2 form the capacitive voltage divider, which is used for measuring the voltage, and the shielding capacitor C3 plays a role of shielding and protecting. As shown in FIG. 3, regarding to an electrical principle diagram of the multifunctional capacitive-type sleeve with a vacuum arc-extinguishing chamber according to the present invention, wherein both the two ends of the main capacitor C1 after in series connection with the voltage-dividing capacitor C2 of one capactive screen group 5, and the two ends of the shielding capacitor C3 of one capactive screen group 5 are respectively connected to the connection terminal at end of the multifunctional capacitive-type sleeve and an earth potential E; both the two ends of the main capacitor C1 after in series connection with the a voltage-dividing capacitor C2 of the other capactive screen group 5, and the two ends of the shielding capacitor C3 the other capactive screen group 5 are respectively connected to the connection terminal at the other end of the multifunctional capacitive-type sleeve and the earth potential E; a current transformer secondary coil CT, i.e., the current transformer secondary coil 6 is sleeved outside the the sleeve insulation core 4, the connection terminals at two ends of the multifunctional capacitive-type sleeve are contacted and separated in the vacuum arc-extinguishing chamber 7 under the effect of the insulating pull rod or the operating mechanism to form a switch DL; and the two capactive screen groups 5 are symmetrically arranged, and no matter which connection terminal forms a high-voltage end U with the electricity, the voltage can be measured. Certainly, a plurality of capactive screen groups 5 can further be arranged in a sleeve insulation core 4, but two are preferred. That is, the voltage can be measured from two ends, and the shielding and insulation protection can be respectively conducted to the connection terminals at two ends and the arc-extinguishing chamber flange 8.

The sleeve with the vacuum arc-extinguishing chamber according to the present invention has simple structure, the sleeve with the structure of multiple sets of the capacitive screens is produced, the vacuum arc-extinguishing chamber is fixed in the sleeve, a capacitive and multifunctional capacitive-type sleeve with the function of the disconnector is obtained after installation of the current transformer, the insulating umbrella skirt, the voltage-sharing flange, the connection terminal and the insulating pull rod. The main capacitor C1 embedded in the sleeve insulation core 4 is composed of a set of coaxial cylindric metal or semi-conducting capacitive screens, and multiple cylindric capacitive screens or semi-conducting capacitive screens form the main capacitor C1 in series; the voltage-dividing capacitor C2 is a set of capacitive screens with larger electric capacity continuously rolled or laid outside the outermost capacitive screen; the shielding capacitor C3 is mutually insulating and mutually overlapped capacitive screen rolled or laid from the connection terminal to the earthing screen end while the main capacitor C1 and the voltage-dividing capacitor C2 are manufactured, and the capacitive screens forming the main capacitor C1, the voltage-dividing capacitor C2 and the shielding capacitor C3 are embedded in the sleeve insulation core 4, and are rolled and laid in sequence.

The contents above further describe the present invention in detail with reference to the specific preferred embodiments, but it cannot be deemed that the detailed embodiments of the present invention are limited to the description. Those skilled in the art of the present invention may make many simple deductions or replacements without departing from the concept of the present invention, which shall all fall within the protection scope of the present invention.

The invention claimed is:

1. A multifunctional sleeve with a vacuum arc-extinguishing chamber, comprising a sleeve with an insulation core covered outside the vacuum arc-extinguishing chamber and a capacitor provided in the insulation core, wherein one end of two connection terminals are respectively led out from two ends of the sleeve insulation core, and other ends of the two connection terminals can be contacted and separated in the vacuum arc-extinguishing chamber to switch on and off a circuit, wherein the capacitor comprises at least two capacitive screen groups, each capacitive screen group being composed of a plurality of coaxial capacitive screens alternatively arranged with an insulating layer embedded in the sleeve insulation core, and each capacitive screen group having an outermost capacitive screen that is an earthing screen, and wherein the two capacitive screen groups are embedded in the sleeve insulation core, the two capacitive screen groups being respectively arranged at the two ends of the sleeve insulation core, and the earthing screens of the two capacitive screen groups being connected.

2. The multifunctional sleeve with the vacuum arc-extinguishing chamber according to claim 1, wherein at least one of the capacitive screen groups comprises main capacitive screens forming a main capacitor, voltage-dividing capacitive screens forming a voltage-dividing capacitor and shielding capacitive screens forming a shielding capacitor; and the main capacitor and the voltage-dividing capacitor are connected in series to form a capacitive voltage divider for providing voltage signal output, and the shielding capacitor plays a role of shielding and protecting.

3. The multifunctional sleeve with the vacuum arc-extinguishing chamber according to claim 1, wherein the plurality of coaxial capacitive screens of each capacitive screen group are arranged to have axially offset ends, from inside to outside gradually along an axial direction from one end of the sleeve insulation core to a middle part provided with the vacuum arc-extinguishing chamber.

4. The multifunctional sleeve with the vacuum arc-extinguishing chamber according to claim 1, wherein the vacuum arc-extinguishing chamber is arranged in a middle part in a chamber of the sleeve insulation core, the vacuum arc-extinguishing chamber having two ends each provided with an arc-extinguishing chamber flange, the two capacitive screen groups are respectively embedded at positions in the two ends of the sleeve insulation core surrounding the two arc-extinguishing chamber flanges, and each capacitive screen in each capacitive screen group surrounds one corresponding arc-extinguishing chamber flange.

5. The multifunctional sleeve with the vacuum arc-extinguishing chamber according to claim 1, wherein the two capacitive screen groups in the sleeve insulation core respectively form the main capacitor, the voltage-dividing capacitor and the shielding capacitor, the main capacitor and the voltage-dividing capacitor are connected in series to form the capacitive voltage divider for providing voltage signal output, and the shielding capacitor plays a role of shielding and protecting; wherein both the two ends of the main capacitor after are in series connection with the voltage-dividing capacitor of one capacitive screen group, and the two ends of the shielding capacitor of one capacitive screen group are respectively connected to the connection terminal at end of the multifunctional capacitive-type sleeve and an earth potential; both the two ends of the main capacitor are in series connection with the a voltage-dividing capacitor of the other capacitive screen group, and the two ends of the shielding capacitor of the other capacitive screen group are respectively connected to the connection terminal at the other end of the multifunctional capacitive-type sleeve and the earth potential; and a current transformer secondary coil is sleeved in a scope of the earthing screen of the two capacitive screen groups outside the sleeve insulation core.

6. The multifunctional sleeve with the vacuum arc-extinguishing chamber according to claim 5, wherein the vacuum arc-extinguishing chamber is arranged in a middle part in a chamber of the sleeve insulation core, of the vacuum arc-extinguishing chamber having two ends each provided with an arc-extinguishing chamber flange, the two capacitive screen groups are respectively embedded at positions in the two ends of the sleeve insulation core surrounding the two arc-extinguishing chamber flanges, each capacitive screen in each capacitive screen group surrounds one corresponding arc-extinguishing chamber flange, and the plurality of coaxial capacitive screens of each capacitive screen group are arranged to have axially offset ends, from inside to outside, gradually along an axial direction from one end of the sleeve insulation core to the middle part provided with the vacuum arc-extinguishing chamber; and the current transformer secondary coil is sleeved outside the sleeve insulation core at a position corresponding to the vacuum arc-extinguishing chamber, two insulating umbrella skirts are respectively sleeved at the two ends outside the sleeve insulation core, and both the two ends of the sleeve insulation core are provided with a voltage-sharing flange.

7. The multifunctional sleeve with the vacuum arc-extinguishing chamber according to claim 1, wherein an insulating umbrella skirt is further sleeved outside the sleeve insulation core, and both the two ends of the sleeve insulation core are provided with a voltage-sharing flange.

8. The multifunctional sleeve with the vacuum arc-extinguishing chamber according to claim 1, wherein one or more current transformer secondary coils are further sleeved outside the sleeve insulation core.

* * * * *